United States Patent [19]

Wilczewski

[11] 3,935,936

[45] Feb. 3, 1976

[54] MEDIA THICKNESS COMPENSATION FOR PRINT HEAD

[75] Inventor: Robert Hugh Wilczewski, Riverton, Wyo.

[73] Assignee: Victor Comptometer Corporation, Chicago, Ill.

[22] Filed: Mar. 1, 1974

[21] Appl. No.: 447,142

[52] U.S. Cl. ..... 197/1 R; 346/139 C

[51] Int. Cl.[2] ..... B41J 3/50

[58] Field of Search ..... 197/1, 18, 49, 55, 126, 197/127, 128, 137, 149; 346/76 R, 74 CH, 74 E, 139 C, 139 A; 235/61.9; 101/35, 41–44, 45; 90/13.2, 13.05

[56] References Cited

UNITED STATES PATENTS

| | | | |
|---|---|---|---|
| 3,363,547 | 1/1968 | Thut et al. | 101/45 |
| 3,653,291 | 4/1972 | Babcock | 90/13.2 |
| 3,675,536 | 7/1972 | Hungerford et al. | 90/13.05 |
| 3,705,408 | 12/1972 | Krone et al. | 346/139 C |
| 3,750,792 | 8/1973 | Liles | 197/1 R |
| 3,776,341 | 12/1973 | Dobner et al. | 197/127 R |

FOREIGN PATENTS OR APPLICATIONS

| | | | |
|---|---|---|---|
| 1,224,696 | 3/1971 | United Kingdom | 197/1 R |

OTHER PUBLICATIONS

Carpenter et al., "Forms Sensor for Automatic Platen," IBM Tech. Disc. Bull., Vol. 13, No. 12, May 1971.

Drejza et al., "Ribbon Compensating Interposer," IBM Tech. Disc. Bull., Vol. 15, No. 3, Aug. 1972.

*Primary Examiner*—Edgar S. Burr
*Assistant Examiner*—R. T. Rader
*Attorney, Agent, or Firm*—McCaleb, Lucas & Brugman

[57] ABSTRACT

In high-speed serial-type wire printer with platen for backing impression-receiving media and carriage for traversing print head having printing wires reciprocable at right angles to platen to effect impressions against media along a print line on platen; a print head mounted on the carriage for independent movement perpendicular to print line, biasing means urging print head away from platen, and a plurality of individually selected rotatable stop members on a shaft in a series extending for length of platen, the shaft being carried by adjustable bearings to insure its being axially parallel to platen, with each stop member comprising polyhedron presenting plurality of peripheral faces each differently spaced from shaft, and a roller on print head for engagement with stop member faces by the biasing means, the print head thereby being maintained a predetermined distance from the media during traversing of carriage regardless of the thickness of the media so as to accommodate media of different thicknesses. A pair of secondary rollers on carriage equidistantly spaced transversely on opposite sides of roller on print head are resiliently maintained in engagement with a rail on machine frame by the biasing means to stabilize and prevent canting of carriage and print head. Each stop member detented by spring pawl engaging in peripheral transverse slots separating faces of stop member, with a bail movable by any spring pawl not engaging a slot to open a control switch to prevent machine operation unless all stop members are in an operative position presenting one of their faces for engagement by the print head roller.

7 Claims, 4 Drawing Figures

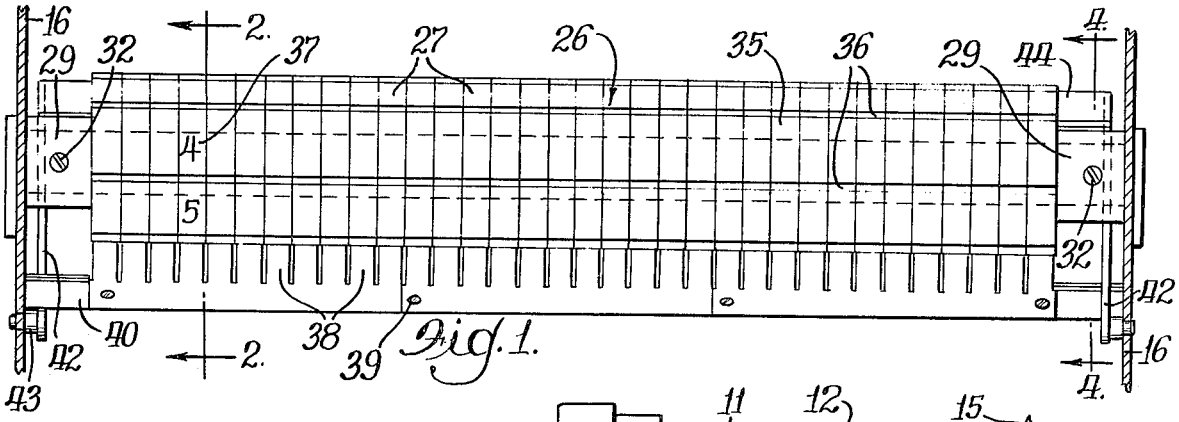
Fig. 1.
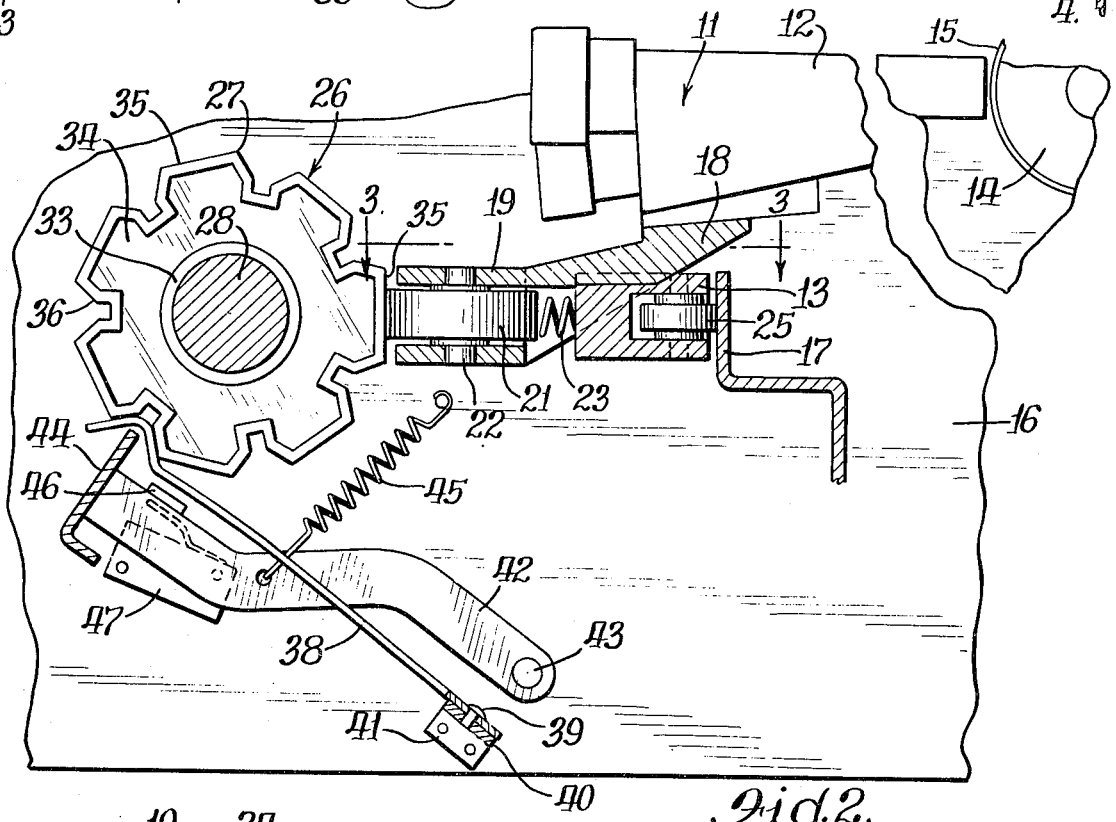
Fig. 2.
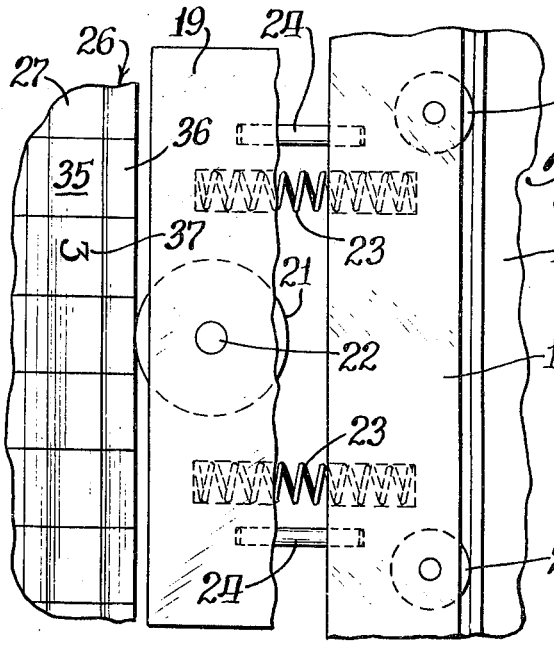
Fig. 3.
Fig. 4.
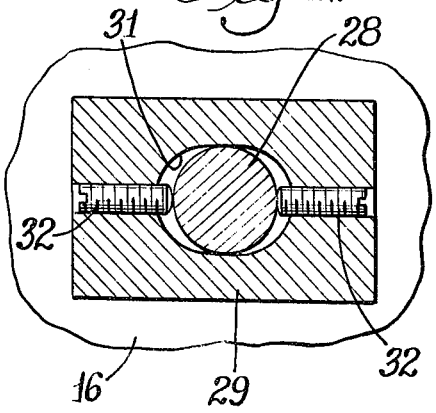

MEDIA THICKNESS COMPENSATION FOR PRINT HEAD

BACKGROUND OF THE INVENTION

1. Field of the Invention

This invention relates generally to high-speed serial-type wire printers, and more particularly to media thickness compensation means for insuring maintenance of the print head a predetermined distance from the impression-receiving media surface regardless of the thickness of the media.

2. Description of the Prior Art

Some high-speed serial-type wire printers are designed to accommodate different thicknesses of impression-receiving media either at different times or simultaneously, such as accounting machines for printing on a tally sheet and, as a part of the same operation, on a pass book. To accommodate such different thicknesses of media, the print head has been mounted on its carriage, which is movable transversely of the platen along a print line, for additional movement relative to the carriage perpendicular to the print line, and provided with spring means urging the print head toward the platen and sensing means for engaging the print or impression-receiving surfaces of the media that are backed by the platen. In one such machine, a roller is mounted on each side of the rear or printing end of the print head, but this results in inaccurate positioning of the printing ends of the wires for the lateral distance between the wires and the center of the roller on the advancing side of the print head and also causes lateral torque or bending forces being imposed on the print head whenever only one of the rollers is in engagement with the media.

Another prior art machine is that disclosed in U.S. Pat. No. 3,750,792 which provides a flexible tape spring-urged into contact with the impression-receiving media that is backed by the platen, and a sensing finger on the rear or printing end of the print head which engages the tape. This results in an artificial gradual movement of the print head perpendicular to the print line rather than the actual abrupt transition between media of different thicknesses, due to the nature of the tape. Both of these prior art machines also are unsatisfactory because in being spring-urged into engagement with the impression-receiving surfaces of the media, the sensing rollers and finger cause streaking of the lower sheets of multiple sheet forms having carbon or other pressure-responsive reproducing means incorporated therein.

SUMMARY OF THE INVENTION

This invention eliminates the objectionable features of the prior art by providing media thickness compensation means which does not engage the impression-receiving media but comprises adjustable stop means mounted on a shaft parallel to the platen and spaced forwardly therefrom, and biasing means for resiliently uring the print head away from the platen and into engagement with the stop means. A roller is mounted on a vertical axis on the print head for such contact with the stop means, with that roller axis being laterally centrally aligned with the printing wires to effect sharp and accurate transitional movements of the print head perpendicular to the print line. In order to prevent canting or twisting in a horizontal plane of the carriage and the print head due to such sharp movements, a rail is mounted on the machine frame parallel to the platen, and a pair of secondary rollers are mounted on the carriage on opposite sides, respectively, from the print head roller which are resiliently maintained in engagement with the rail by the print head biasing means. The adjustable stop means comprises a shaft mounted on the frame by bearings adjustable to insure parallelism with the platen, and a plurality of individual stop members rotatable on the shaft in a series extending for the length of the platen, with each being a polyhedron presenting a plurality of peripheral faces each differently spaced from the shaft. Detenting means are provided for retaining each stop member in selected operative position, and a bail is mounted for actuation by any one of the detenting means which is not retaining its stop member in an operative position to open a normally closed control switch to automatically prevent machine operation unless all of the stop members are in an operative position.

In the drawings:

FIG. 1 is a front elevation of media thickness compensation means embodying this invention, with parts of the machine frame in section;

FIG. 2 is a detail vertical section taken substantially on the line 2—2 of FIG. 1 on an enlarged scale and with parts broken away;

FIG. 3 is a detail plan view, with parts broken away, as seen from the line 3—3 of FIG. 2; and FIG. 4 is a detail vertical section taken substantially on the line 4—4 of FIG. 1 on an enlarged scale.

DESCRIPTION OF THE PREFERRED EMBODIMENT

Referring more particularly to FIG. 2, reference numeral 11 indicates in general a high-speed serial-type printer, preferably like that in copending application for U.S. pat. Ser. No. 313,248, filed Dec. 8, 1972, although any other wire printer such as that disclosed in U.S. Pat. No. 3,750,792 may have the present invention incorporated in it. For purposes of the instant disclosure, the printer 11 includes a print head 12 mounted for horizontal front-to-rear movement on a carriage 13 that is movable transversely along a print line on a platen 14, the details of which form no part of this invention. The print head 12 includes printing wires reciprocable in a plane substantially at right angles to the surface of the platen 14 to effect impressions on media 15 shown in FIG. 2 as being backed by the platen. These several parts are mounted in well known manner on the machine frame, which is herein illustrated as including vertical side frame members 16, and secured in any desired manner to the frame members 16 is a transverse rail 17 which is parallel to the platen 14. As noted, the specific means for traversing carriage 13 and its print head 12 along a print line defined by platen 14 and for actuating the printing wires longitudinally to effect impressions against media backed by the platen are not part of this invention so that they are not illustrated herein.

Means are provided, as previously indicated, for mounting the print head 12 on the carriage 13 for movement relative thereto perpendicular to the print line on the platen 14 which comprises a suitable slide member 18 depending from the print head and having a forward extension 19 with a central horizontal slot receiving a roller 21. The roller 21 extends forwardly (to the left in FIG. 2) beyond the front edge of the slide extension 19 and is rotatably mounted on a spindle 22 carried by the latter. Interposed between the slide extension 19 and the carriage 13, as best seen in FIG. 3, is a biasing means comprising a pair of coil springs 23 having their ends housed in suitable guide apertures equidistantly spaced laterally from the axis of roller 21. If desired, additional guide means for sliding movements of the print head 12 relative to the carriage may take the form of pins 24 slidably received in suitable horizontal apertures in the adjacent portions of the carriage 13 and slide extension 19. As seen in FIGS. 2 and 3, a pair of secondary rollers 25 are rotatably mounted in suitable slots in the carriage 13 to extend rearwardly therefrom for engagement with the rail 17. These secondary rollers 25 are equidistantly spaced transversely from, and on opposite sides of, the roller 22 and are resiliently maintained in engagement with the rail 17 by the biasing means 23. It thus will be seen that the biasing means 23 resiliently urges the print head 12 forwardly away from the platen 14, such movement being limited by the roller 21 in a manner now to be described, and the biasing means also maintains guiding engagement of the rollers 25 with the rail 17.

Forward movements of the roller 21 by the biasing means 23 are limited to accommodate different thicknesses of impression-receiving media 15 by media thickness compensating means indicated generally in FIGS. 1 and 2 by reference numeral 26 and comprising adjustable stop means in the form of a plurality of individual stop members 27 rotatable on a shaft 28 in a series extending for the length of platen 14. It is essential that the print head 12 be held to extremely accurate positions relative to platen 14 and, to this end, the shaft 28 must be mounted exactly parallel to the platen. This is accomplished by providing an adjustable bearing block 29 secured in any suitable manner to each side frame member 16, with each block having a horizontally elongated aperture 31 (FIG. 4) engaging an end of shaft 28 and opposed screw means 32 engaging the shaft and adjustable to insure mounting of the shaft axially parallel to the platen.

Each individual stop member 27 (FIG. 2) is in the form of a polyhedron and comprises a cylindrical hub 33 rotatable on the shaft 28 and a web 34 joining the hub and a plurality of peripheral faces 35, each differently spaced from the hub and, therefore, from the shaft 28. It is preferred that each stop member 27 be formed from a suitable plastic and, in the illustrated embodiment, with seven faces 35 and adjacent faces separated by transverse grooves 36. The face 35 engaged by roller 21, as shown in FIG. 2, is the only one on that stop member 27 that is in active position, and it is illustrated as maintaining the rear or right hand end of the print head 12 spaced from platen 14 the desired minimum distance to accommodate an impression-receiving media 15 of minimum thickness. Therefore, the radial distance of that active face 35 in FIG. 2 from the shaft 28 is the maximum, and the radial distance of each successive face 35 therefrom in a counterclockwise direction decreases incrementally, with the seventh such face being the closest to the shaft so as to determine the position of the print head to be a maximum distance from the platen when that seventh face is in active position. To facilitate manual adjustment of the stop members 27, suitable identifying indicia 37 are inscribed on the several faces 35, preferably with 1 on that farthest from shaft 28 and successively around to 7 on the face spaced most closely to the shaft and adapted to permit the biasing means 23 to position the rear end of the print head 12 in proper cooperative relation to a maximum thickness of impression-receiving media 15 backed by platen 14. A specific arrangement found to be satisfactory for commercial usage is to provide for a range of print head movement of 0.024 inch between minimum and maximum spacing of the front end thereof from the platen. To attain this with the illustrated embodiment, the 2 face 35 of each stop member 27 is 0.003 inch closer to shaft 28 than its 1 face 35, which is shown in FIG. 2 in active position; the 3 face is 0.003 inch closer to the shaft than the 2 face; the 4 face is 0.004 inch closer to the shaft than the 3 face; the 5 face also is 0.004 inch closer than the 4 face; and the 6 and 7 faces 35 are successively 0.005 inch closer to the shaft 28 than the respective preceding lower numbered face.

Thus, those stop members 27 that are aligned from front to rear of the machine with any impression-receiving media 15 backed in printing position by the platen 14 may be selectively adjusted rotatably on shaft 28 to dispose in active position their particular faces 35 which will insure proper positioning of the printing end of print head 12 relative to that specific media. It will be appreciated that media of different individual thicknesses may be mounted in the machine in different locations along the platen 14 at the same time, but so long as the stop members 27 that are aligned therewith are properly adjusted to dispose their faces 35 that are space-related to that particular media thickness in operative position, transverse movement of the carriage 13 will automatically be accompanied by proper movement of the print head 12 relative to the carriage perpendicular to the print line on the platen as the print head moves laterally from one media to that next adjacent to it. This will be a sharp movement of the print head toward or away from the platen to accurately accommodate media of different thicknesses, rather than the gradual movement obtained with the prior art means previously noted that prevents printing on marginal portions of the media. Incidentally, since the widths of most impression-receiving media are in whole or half inches, the individual stop members 27 preferably are one-half inch wide. And it will be appreciated that because the media thickness compensation is effected by rolling contact of the roller 21 with the stop member faces 35, there can never be any marking of, or damage to, the media.

Detent means are provided for retaining the stop members 27 in selected operative positions which comprises a spring pawl 38 for each stop member (FIG. 2) having one end secured to the machine frame and a free end engageable in the grooves 36 of the associated stop member. To facilitate manufacture and assembly, a plurality of the pawls 38 are formed as an integral stamping from a sheet of spring steel with the lower marginal edge (FIGS. 1 and 2) uncut and attached, as by screws or the like 39, to the upper face of a transversely extending bar 40 having downturned ends 41 (FIG. 2) secured in any suitable manner to the side frame members 16.

A bail having legs 42 pivotally mounted at 43 in the side frame members 16 and a transversely extending portion 44 is resiliently held in an upper, inoperative position (FIG. 2) by spring means 45 secured at their lower ends to the legs 42 and at their upper ends to the frame members 16. This bail 42, 44 also has a switch operating portion 46 overlying the actuating member of a normally closed control switch 47 mounted on one of the side frame members 16 and suitably connected in series with the machine motor (not shown). With such construction, whenever any detend pawl 38 is not engaging in one of the groves 36 to hold one of the faces 35 of its associated stop member 27 in operative position, its upper end will have been moved downwardly by its stop member to swing the bail 42, 44, 46 against the spring means 45 to open the control switch 47. Damage to the parts of the machine which might occur because of inaccurate positioning of any of the selectively operable stop members 27 thus is prevented.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the form hereinbefore described being merely a preferred embodiment thereof.

I claim:

1. In a high-speed serial-type wire printer having a frame, a platen mounted on said frame for backing impresseion-receiving media, a carriage movable transversely of said platen, a print head carried by said carriage with printing wires reciprocable in a plane substantially at right angles to the surface of said platen to effect impressions against said media during transverse movement of the print head by said carriage along a print line on said platen; media thickness compensation means for maintaining said print head a predetermined distance from said media regardless of the thickness of the latter to accommodate media of different thicknesses disposed along said print line, comprising means for mounting said print head on said carriage for movement relative thereto perpendicular to said print line, biasing means for resiliently urging said print head away from said platen, and adjustable stop means engageable by said print head in response to said biasing means, wherein said adjustable stop means comprises a shaft mounted on said frame axially parallel to said platen, and a plurality of individual stop members rotatable on said shaft in a series extending for the length of said platen, and wherein each said stop member comprises a polyhedron presenting a plurality of peripheral faces each differently spaced from said shaft.

2. In a media thickness compensation means according to claim 1, a roller rotatably mounted on said print head for engagement with said stop member faces, said biasing means urging said roller into engagement with said stop member faces.

3. In a media thickness compensation means according to claim 2, a rail secured to said frame parallel to said platen, and a pair of secondary rollers mounted on said carriage equidistantly spaced transversely on opposite side, respectively, from said roller and resiliently maintained in engagement with said rail by said biasing means.

4. In a media thickness compensation means according to claim 1, identifying indicia on said face of each said stop member indicating a particular media thickness with which said print head will be properly positioned when that stop member face is in operative position.

5. In a media thickness compensation means according to claim 1, wherein each said stop member is manually rotatable to position any selected said face in operative position relative to said print head, detent means for frictionally retaining said stop members in selected operative positions.

6. A media thickness compensation means according to claim 5, wherein adjacent faces of each said stop member are separated by transverse grooves, and said detent means comprises a spring pawl for each said stop member having one end secured to said frame and a free end engageable in said grooves of the associated said stop member.

7. In a media thickness compensation means according to claim 6, a normally closed control switch, a bail having legs pivotally mounted on said frame, a transversely extending portion engageable with said free ends of said pawls, and a switch operating portion, and spring means resiliently holding said bail in an inoperative position, whereby rotation of any stop member to any position in which none of its said faces is in operative position will move its associated said pawl to swing said bail against said spring means to open said control switch.

* * * * *